US005576593A

United States Patent [19]

Schultheiss et al.

[11] Patent Number: 5,576,593

[45] Date of Patent: Nov. 19, 1996

[54] APPARATUS FOR ACCELERATING ELECTRICALLY CHARGED PARTICLES

[75] Inventors: Christoph Schultheiss, Karlsruhe; Martin Konijnenberg, Alsbach; Markus Schwall, Eggenstein-Leopoldshafen, all of Germany

[73] Assignee: Kernforschungszentrum Karlsruhe GmbH, Karlsruhe, Germany

[21] Appl. No.: 301,078

[22] Filed: Sep. 6, 1994

Related U.S. Application Data

[63] Continuation-in-part of PCT/DE93/00253 Mar. 18, 1993.

[30] Foreign Application Priority Data

Mar. 19, 1992 [DE] Germany ..... 42 08 764.3

[51] Int. Cl.[6] ..... H05H 9/00

[52] U.S. Cl. ..... 313/231.31; 313/361.1; 313/362.1; 250/398; 315/505

[58] Field of Search ..... 313/231.31, 360.1, 313/361.1, 362.1; 250/398, 288; 315/505, 507

[56] References Cited

U.S. PATENT DOCUMENTS

| | | | |
|---|---|---|---|
| 3,546,524 | 12/1970 | Stark | 315/505 |
| 3,864,640 | 2/1975 | Bennett . | |
| 4,020,384 | 4/1977 | Richards . | |
| 4,128,764 | 12/1978 | Luce | 250/398 |
| 4,363,774 | 12/1982 | Bennett . | |
| 4,748,378 | 5/1988 | Frost et al. . | |
| 4,912,421 | 3/1990 | Anderson | 313/361.1 |

FOREIGN PATENT DOCUMENTS

| | | | |
|---|---|---|---|
| 0282467 | 9/1988 | European Pat. Off. . | |
| 0403418 | 12/1990 | European Pat. Off. . | |
| 3834402 | 5/1989 | Germany . | |
| 63-100364 | 5/1988 | Japan | 313/231.31 |
| 793343 | 1/1982 | U.S.S.R. | 315/505 |
| 9216959 | 10/1992 | WIPO . | |

OTHER PUBLICATIONS

Nuclear Instruments & Methods in Physics Research, vol. A278 No. 1, May 15, 1989, Amsterdam pp. 206–212.

Nuclear Instruments & Methods, vol. 205, No. 1–2, Jan. 15, 1983 Amsterdam pp. 173–184.

*Primary Examiner*—Sandra L. O'Shea
*Assistant Examiner*—Matthew J. Esserman
*Attorney, Agent, or Firm*—Klaus J. Bach

[57] ABSTRACT

In an apparatus for accelerating electrically charged particles from a pulsed plasma reservoir of high particle density in a dielectric tubular chamber which extends from the reservoir and is surrounded by at least two electrodes of which one is disposed at the wall of the reservoir, the dielectric tubular chamber is partially evacuated to a sufficiently low pressure p such that the product of the gas pressure p and the inner diameter d of the tubular chamber is low enough to avoid parasitic discharges in the residual gas charge, and a voltage is applied to the electrodes such that the particles are drawn into the dielectric tubular chamber with high flow density and are accelerated therein thereby forming a charged particle beam whereby the residual gas charge in the dielectric tubular chamber is ionized along the inside wall of the tubular chamber and polarized such that the wall of the dielectric tubular chamber becomes repulsive for the charged particle beam and its axis becomes attractive whereby the charged particle beam is electrostatically focussed and exits the dielectric tubular chamber with log losses.

12 Claims, 7 Drawing Sheets

APPARATUS FOR ACCELERATING ELECTRICALLY CHARGED PARTICLES

This is a continuation-in-part application International application PCT/DE93/00253 filed Mar. 18, 1993, and claiming priority of German application P 42 08 764.3 of Mar. 19, 1972.

BACKGROUND OF THE INVENTION

The invention relates to a particle beam accelerator for generating an electrically charged particle beam.

With such accelerators, particles of a predetermined charge and mass are extracted from a reservoir and supplied to an acceleration chamber formed between two different electrical potentials to finally provide a beam for use in further treatment procedures.

Patent DP 38 34 402 discloses a process in which the magnetically self-focussed electron beam or a pseudo-spark discharge is received at the anode exit of an electrically insulating quartz tube and is transported therein over a certain distance. A slight curvature or the tube has no noticeable effect on the beam transport and accordingly facilitates the search for the most suitable impact angle of the beam onto the target. To a certain degree, the tube protects the pseudo-spark chamber from ablation vapors and permits differential pumping because of the small pump cross-section. The generation or the electron beam with the technically complicated pseudo-spark chamber however is limited with regard to beam strength and divergence.

It is the object of the invention to achieve high particle beam intensities or equivalent thereto a high current, that is, a high current density, and a sharp focussing of the particle beam by economically acceptable means and expenditures.

SUMMARY OF THE INVENTION

In an apparatus for accelerating electrically charged particles from a pulsed plasma reservoir of high particle density in a dielectric tubular chamber which extends from the reservoir and is surrounded by at least two electrodes of which one is disposed at the wall of the reservoir, the dielectric tubular chamber is partially evacuated to a sufficiently low pressure p that the product of the gas pressure p and the inner diameter dot the tubular chamber is low enough to avoid parasitic discharges in the residual gas charge, and a voltage is applied to the electrodes such that the particles are drawn into the dielectric tubular chamber with high flow density and are accelerated therein thereby forming a charged particle beam whereby the residual gas charge in the dielectric tubular chamber is ionized along the inside wall of the tubular chamber and polarized such that the wall of the dielectric tubular chamber becomes repulsive for the charged particle beam and its axis becomes attractive whereby the charged particle beam is electrostatically focussed and exits the dielectric tubular chamber with low losses.

It is essential that the charged particles in the reservoir are inducted, under high current strength and current density, into a dielectric tubular chamber beginning with the electrode which forms part of the reservoir wall and are accelerated there by way of the potential difference between the two electrodes. Upon arrival the particles in a target chamber at the end of the dielectric tubular chamber they have reached their process energy. For the beam formation it is further important that a residual gas charge with the remaining pressure p is ionized in the dielectric tubular chamber by the particle beam and electrically polarized. The charge cloud at and along the inner tube chamber wall is repulsive with respect to the particle beam. A space charge compensation and an electrostatic focussing the particle beam occurs. This process proceeds well if the product of the residual gas pressure p and the inner diameter d of the tube is so low that the acceleration potential between the electrodes applied from without remains effective essentially for the particle beam acceleration in spite of parasite discharges in the residual gas charge.

In the embodiments described hereafter, additional features are disclosed by which a beam deflection or a change in beam cross-section are achieved. Further, steps for a predetermined beam acceleration are described.

For example a beam deflection is achieved by a locally limited magnetic field in the area of the tubular chamber. By changing the cross-section of the dielectric tubular chamber the cross-section of the particle beam is changed.

For the adjustment of the process energy of the particle beam or its beam strength it may be suitable to reduce the length of the acceleration distance by means of a resistively or inductively coupled auxiliary electrode arranged between the two electrodes. In addition the acceleration distance for the particle beam is divided in a well defined manner by a potential control via resistively coupled auxiliary electrodes arranged between the two main electrodes.

For the performance of the process the particle accelerator as described herein is well suited. In order to be capable to withdraw the charged particles from the reservoir with a strong flow, one of the electrodes forms part of the reservoir wall. The tubular dielectric space begins at such electrode or others if a plurality would be suitable. The opposite electrode is arranged outside the reservoir. The dielectric tubular chamber extends toward the opposite electrode.

It was found experimentally that the geometry of the arrangement is optimal when the length of the tubular chamber is at least three times its inner diameter. In order to maintain the axial electrical insulation even with contamination, the tubular chamber is formed suitably partially or fully by a system of aligned dielectric tube segments. The segments together define radially shaped slots which prevent surface currents.

Advantageously the slot arrangement is provided in such a way that radiation or particles emanating radially from the tube axis will not reach the radial slot end or only by way of a long detour.

For the improvement of the particle beam formation, an electrically sufficiently insulated gas supply is arranged at the end of the tube adjacent the opposite electrode by which gas can be supplied to the tubular chamber in opposite directions.

A noticeable quality improvement of the particle beam can be attributed at one hand essentially to the replacement of the pile of electrodes and insulators of the pseudo-spark length by a tubular chamber delimited by a dielectric material which, in the example described below, is a quartz tube or an assembly of aligned quartz tube sections. On the other hand, the high beam quality is, to a large extent, the result of the particular formation of a charged particle flow with quartz tube arrangement.

BRIEF DESCRIPTION OF THE DRAWINGS

FIG. 1*a* shows a cross-section through the dielectric tube with positive space charge along the axis and negative space charge collection along the tube wall as when the particle beam is formed by electrons;

DESCRIPTION OF THE PREFERRED EMBODIMENTS

Figure 1A:
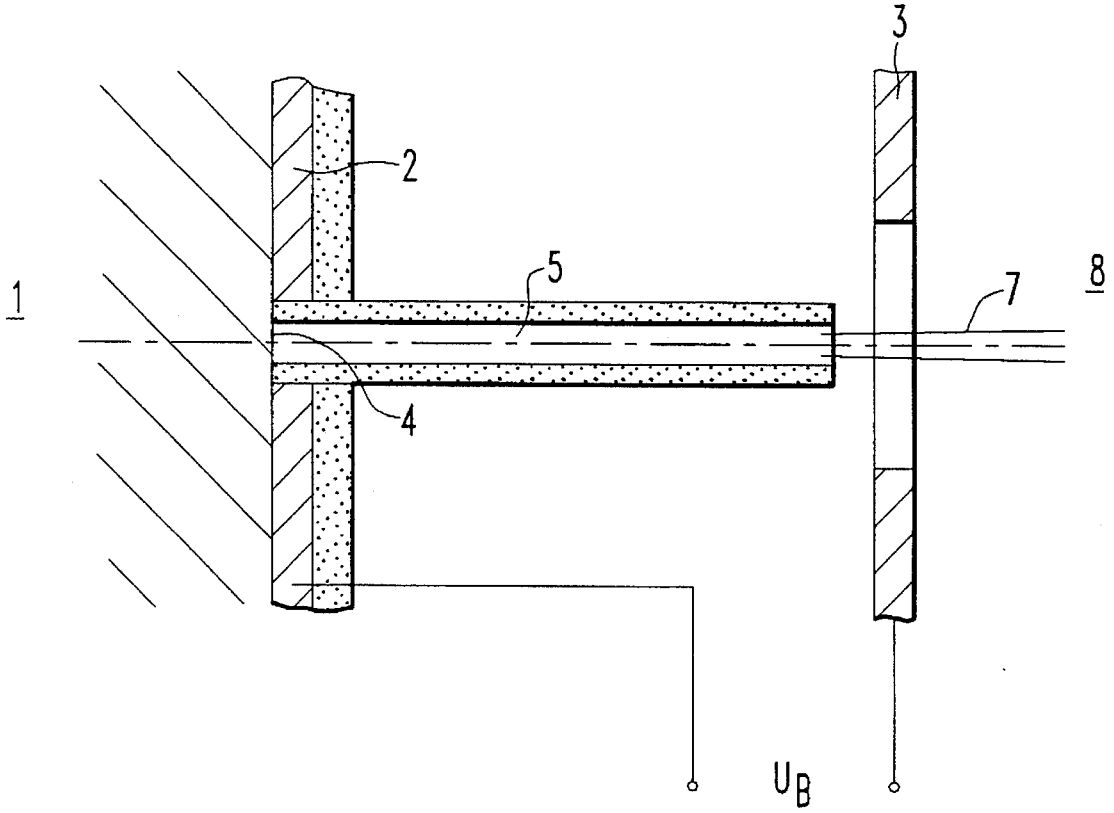
FIG. 1*a* is a schematic representation of the acceleration and transport path for the particle beam.

In an involved testing procedure it was found that the electron beam which leaves the quartz tube consists of two components, specifically one component from the gas discharge in the pseudo-spark chamber and a component derived from the authentic beam formation in the quartz tube.

First, the electron beam from the pseudo-spark chamber is coupled into the dielectric tube reliably only if the end of the dielectric tube is disposed on an intermediate electrode and it does this better the more cathodically the dielectric tube is charged, that is, the deeper it is inserted into the pseudo-spark chamber.

Measurements with a voltage sensing head show that, then, the electrons from the pseudo-spark chamber charge the intermediate electrode on which the dielectric tube is disposed strongly negatively (up to cathode potential) within 100 ns whereupon the cathode end of the dielectric tube draws in electrons from the plasma in the canal of the pseudo-spark chamber and forms an electron beam which, with regard to travel range (after leaving the dielectric tube), parallelism and efficiency, is superior to the pseudo-spark chamber electron beam. The plasma in the canal of the pseudo-spark chamber serves as an electron source and reservoir.

In this manner, it is possible in accordance with the invention to generate in an apparatus (FIG. 1*a*) magnetically self-focussing electron beams 7 which apparatus, for example, consists of a pulsed, high density plasma reservoir 1, of a rapidly variable hollow cathode and of a dielectric tube 5 extending into the cathode and having one end with an opening 4 in communication with the reservoir 1. The other end of the dielectric tube 5 extends—insulated from the cathode electrode 2—freely into a receiver 8 (see FIG. 2).

Figure 2:
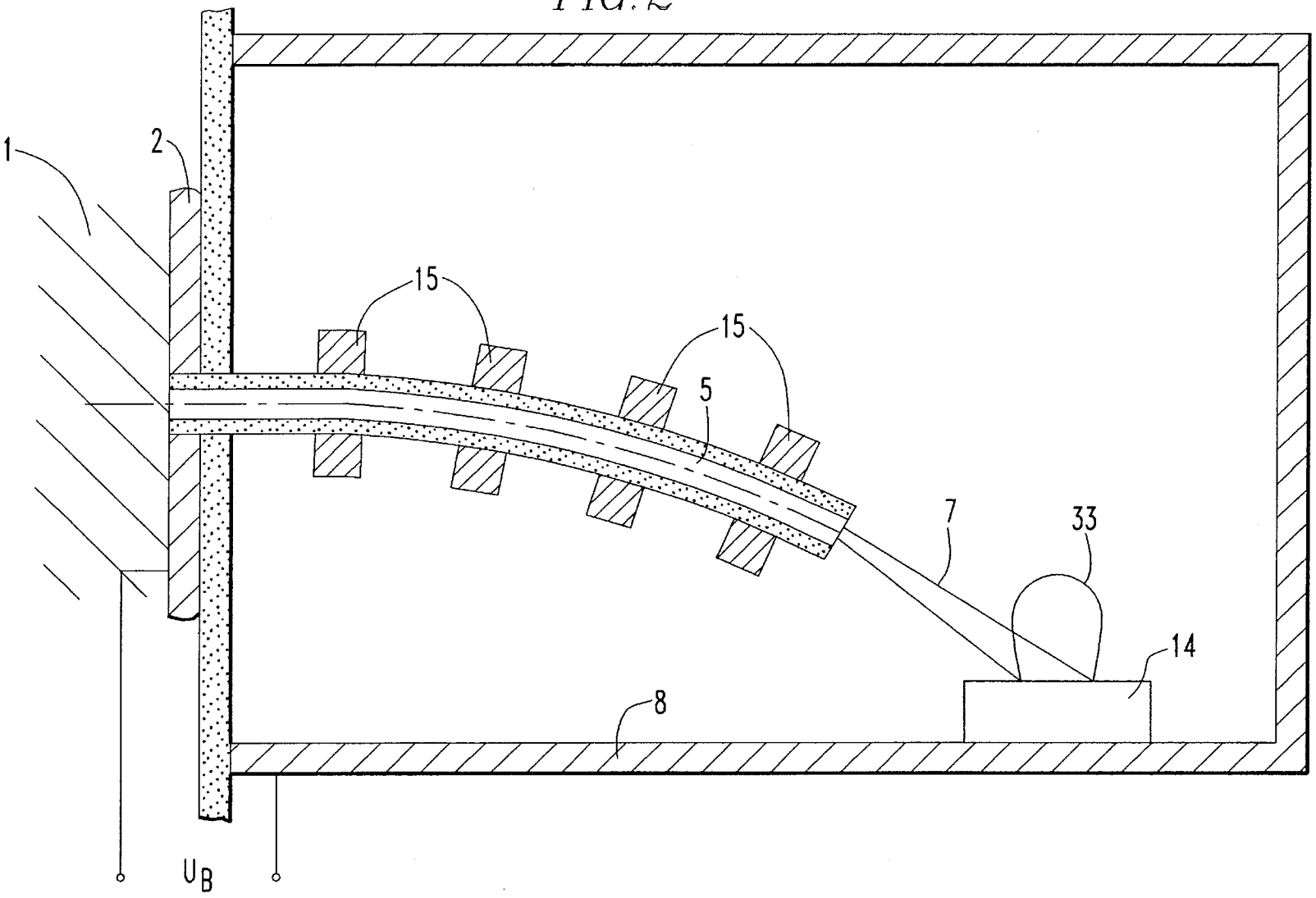
FIG. 2 shows a curved acceleration and transport path in a receiver with additional magnetic beam focussing.

From this end a sharply focussed electron beam 7 with a half-width time of 100 ns is formed which, even after 6 cm of free travel, still shows ablation effects as indicated in FIG. 2 by the material cloud 33.

In the arrangement described, the anode 3 plays a subservient role. The anode 3 may even be eliminated.

The role of the anode 3 is then taken over by the metallic receiver 8. Both collect the negative excess charge and, from it, form the return current to the capacitors.

For the generation of particle beams 7 of high flow density such as $10^4$A/cm$^2$ for electrons, external electrostatic or magnetic focussing is insufficient. For the reduction the space charge, the dielectric tube chamber must include a residual gas charge with a pressure p. The particle beam 7 ionizes and polarizes the remaining gas so that the wall of the dielectric tubular chamber 5 is repulsive for the particle beam 7 and the axis is charged to be attractive (see schematic representation in FIG. 1*b*). Because of the distribution of the negative space charge 38 over the interior wall of the tube 5, the space charge repulsion along the axis 12 is reduced or the electron beam 7. At the same time, the negative charge 38 at the wall is drawn out of the tube 5 by the outer electric field such that the charge carriers, which have been formed by the gas, provide for a positive excess charge 39. This positive excess charge 39 reduces the negative space charge coming with the beam 7.

The profile of the electron beam is similar to a hollow cylinder. This suggests a remaining space charge repulsion during the acceleration process. Upon leaving the tubular chamber 5 the beam 7 remains stable and expands only slightly along a travel distance of 15 cm; but the residual pressure in the receiver 8 must not exceed 0.2 Pa (oxygen). The profile of the beam 7 points to the capacity of the tubular chamber 5 to also retain and accelerate those electrons which would split from the beam in an open acceleration arrangement. This explains the high efficiency of the particle acceleration in the tubular chamber 5. But to avoid electron losses, the dielectric tube 5, that is, its first section, must have a length of at least three times its inner diameter.

In the given example for the generation of an electron beam, the voltage collapse at the tube 5 occurs at about 4 Pa with an applied voltage of 20 kV and a diameter d of the dielectric tube of 3 mm. The preferred operating pressure range for the given example is between 0.1 Pa and 1.5 Pa. As gas charge, oxygen was utilized, but any other gas may be used for residual gas charge.

The diagnosis of the energy distribution of the electrons by means of X-ray heterochromatic radiation and magnetic field spectroscopy shows that, in the preferred pressure range mentioned above, the energy distribution of the electrons remains constant as a result of the collective effects thereof. With an externally applied voltage of 20 kV, an average electron energy of 11 to 12 keV is measured over a period 70 nsec independently of fluctuations in the total flow in the tube which reaches up to 6 kA.

It is found that the extracted electron flow increases if an auxiliary electrode 9 is integrated into the dielectric tube 5 which is connected to the anode 3 (FIG. 3*a*) by way of an ohmic or inductive resistor 10. The resistor 10 is so dimensioned that, beginning with a small current (10 mA-10 A) the anode potential drifts away from the auxiliary electrode 9 and the potential is applied to the dielectric tube 5 as a whole. This measure is recommended generally, but particularly then, when the dielectric tube 5 is very long (for example, 100 cm) and/or curved and/or if, for a reduction or an increase in the current density, the cross-section along the dielectric tube is changing. If the dielectric tube is curved as shown in FIG. 2, also spaced magnets 15 are provided to apply locally limited magnetic fields to the beam for bending the beam.

Figure 3A:
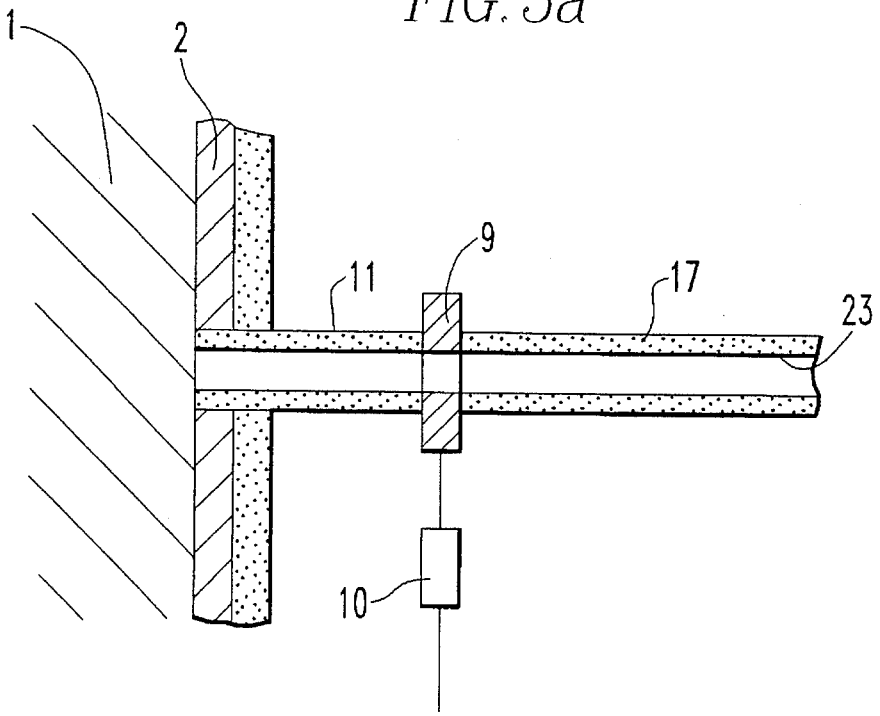
FIG. 3*a* shows a division of the dielectric tube into acceleration and transport paths by mean of an auxiliary electrode.

The length from the reservoir 1 to the auxiliary electrode 9 in FIG. 3*a* is called canal accelerator 11 and the formation of the particle beam 7 is called canal discharge. The section from the auxiliary electrode 9 to the anodic end of the dielectric tube 5 is designated beam guide 17.

Figure 4A:
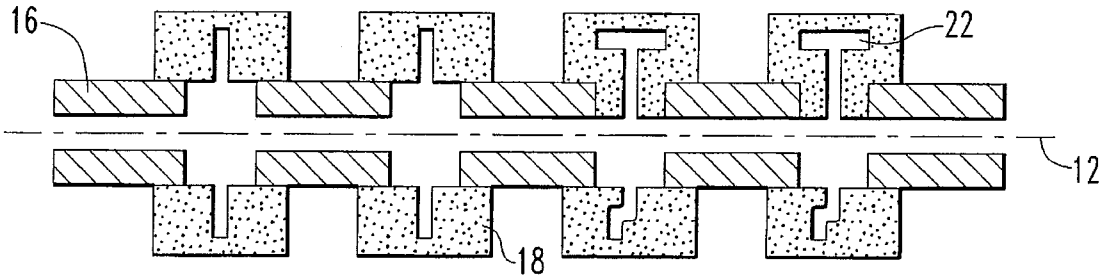
FIG. 4*a* shows a basic radial tube chamber expansion between the tube segments.
Figure 4B:
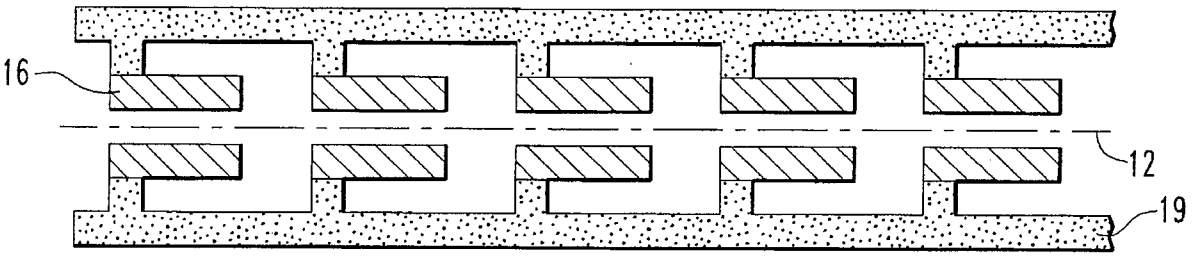
FIG. 4*b* shows a constructively simple tube chamber expansion.
Figure 4C:
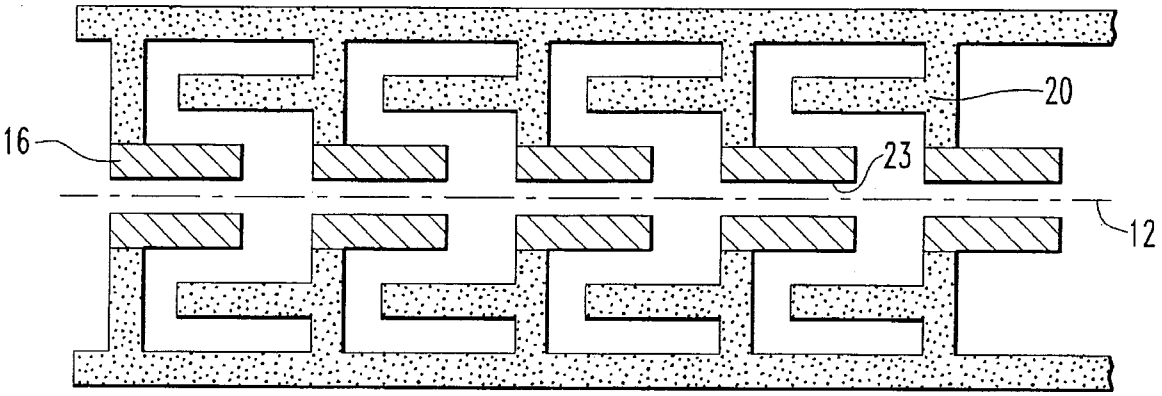
FIG. 4*c* shows a constructively involved tube chamber expansion.

The electric insulation capability of the inner wall 23 of the accelerator tube 5 is impaired by contamination; this will result in a misfunction in the operation of the canal discharge. Also, the occurrence of a secondary discharge in the adsorbates of the inner wall 23 of the dielectric tube 5 is unavoidable when the particle flow from the reservoir 1 increases. The discharge at the inner wall of the dielectric tube 5 leads to a shielding of the outer field whereby the focussing of the particle beam 7 from the reservoir 1 onto the tube axis is inhibited. To suppress full-length wall currents, FIGS. 4*a*, 4*b* and 4*c* show three examplary solutions for a segmented arrangement 16 of the tube 5, each time in connection with a dielectric body 18, 19, 20 which includes an inner radial gap or any topological slot formation, which results in a disruption of possible damaging inner surface currents along the wall 23, from one to another dielectric tube segment. The slots may also include a recess 22 or similar which prevents the passing of vapors into the remote slot areas. In this manner isolation of the segments from one another is insured which results in reliable functioning of the canal discharge.

Figure 1B:
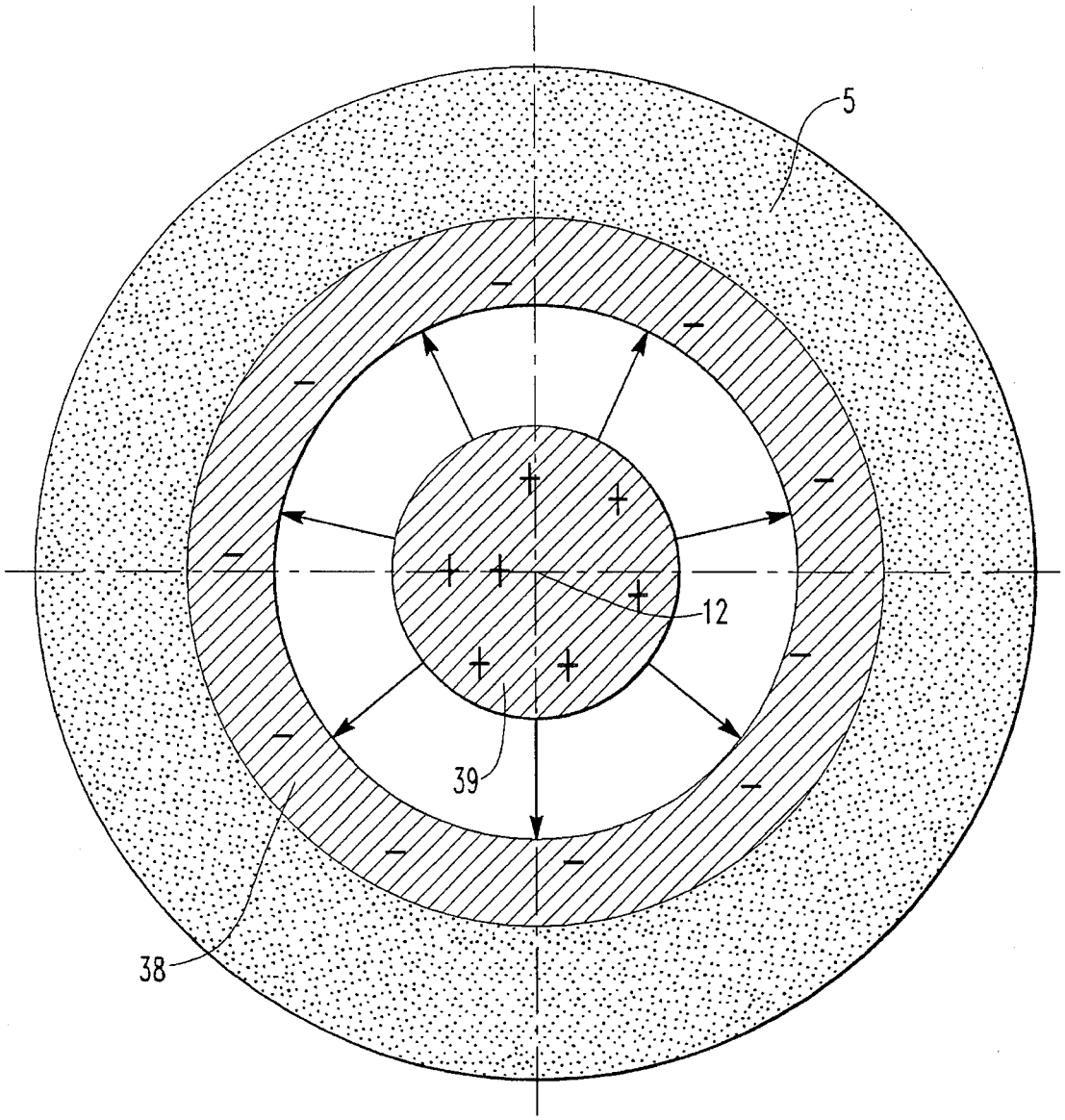

It is also possible to utilize, in place of a rapidly variable hollow cathode, a pulsed surface discharge—or laser plasma as reservoir 1 for electrons as shown in FIG. 1*a*. For the transportation of the high-current beam in the anode chamber it is however necessary to maintain a minimum pressure of about 0.2 Pa.

Figure 6:
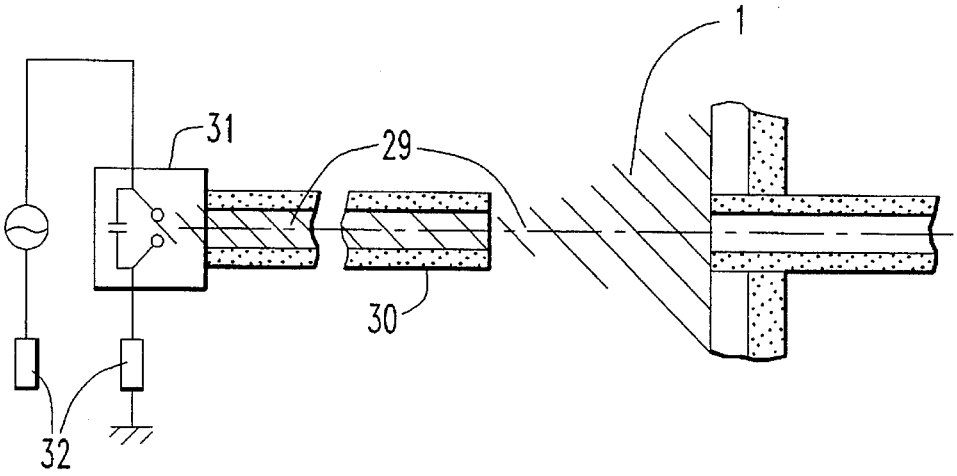
FIG. 6 shows an electrically high-charge particle reservoir, a simple schematic example for the particle generation and the withdrawal into the tubular chamber.

If the reservoir 1 is at a high potential a trigger plasma 29 can be conducted through a dielectric tube 30 of about the same diameter and the same length as the canal accelerator tube 11 into the reservoir 1 and operation can then be initiated. The other end of the dielectric tube is grounded with the trigger source 31 by way of a resistor 32 in such a way that possible side discharges to the trigger source 31 are not destructive (see FIG. 6).

Figure 5:
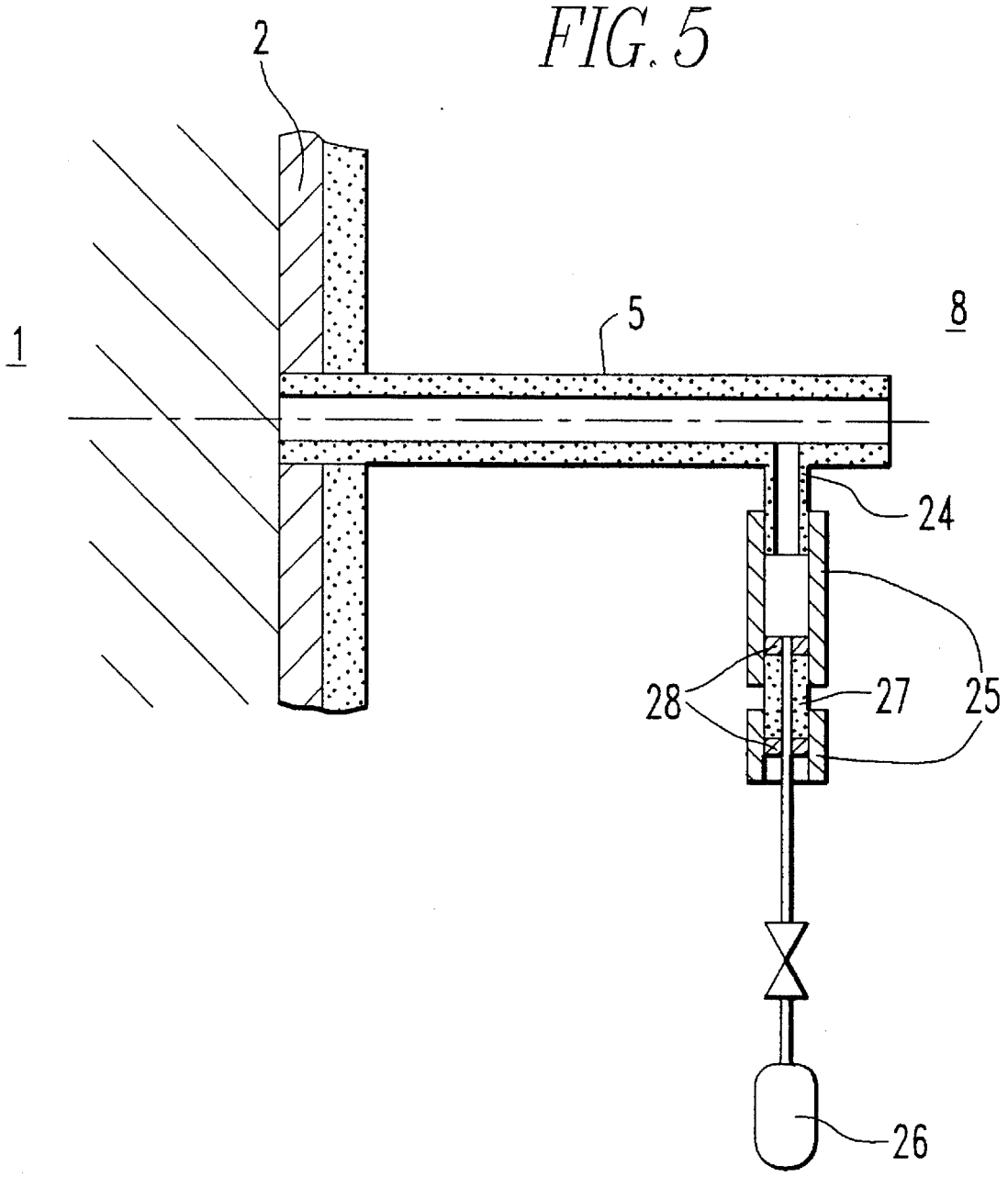
FIG. 5 shows a tube space with electrically uncoupled pumping device.

Pressure differences between the reservoir 1 and the target chamber or receiver 8, in which the opposite electrode 3 is disposed, can be easily achieved by differential pumping since the pump resistance of the dielectric tube 5 increases with the inner diameter in the 4th exponent and linearly with its length. A reliable protection of the whole dielectric tube system from contamination is insured if, at the end of the dielectric tube 5 toward the opposite electrode 3, a gas supply 24 is connected to the tube 5 so that the gas can enter in the direction toward the reservoir 1 as well as toward the receiver 8 in which the opposite electrode 3 is disposed (FIG. 5). To avoid parasitic gas discharges between the dielectric tube 5 and the gas source 26 it is necessary to provide in the gas admission hose 25 between the end of the tube and the gas source 26 a further dielectric tube portion 27 which has an inner diameter of at most ½ d and is metal coated at both end faces or has electrodes 28 at its end faces wherein the electrode 28 facing the gas source 26 is grounded and the other is free-floating.

Figure 3B:
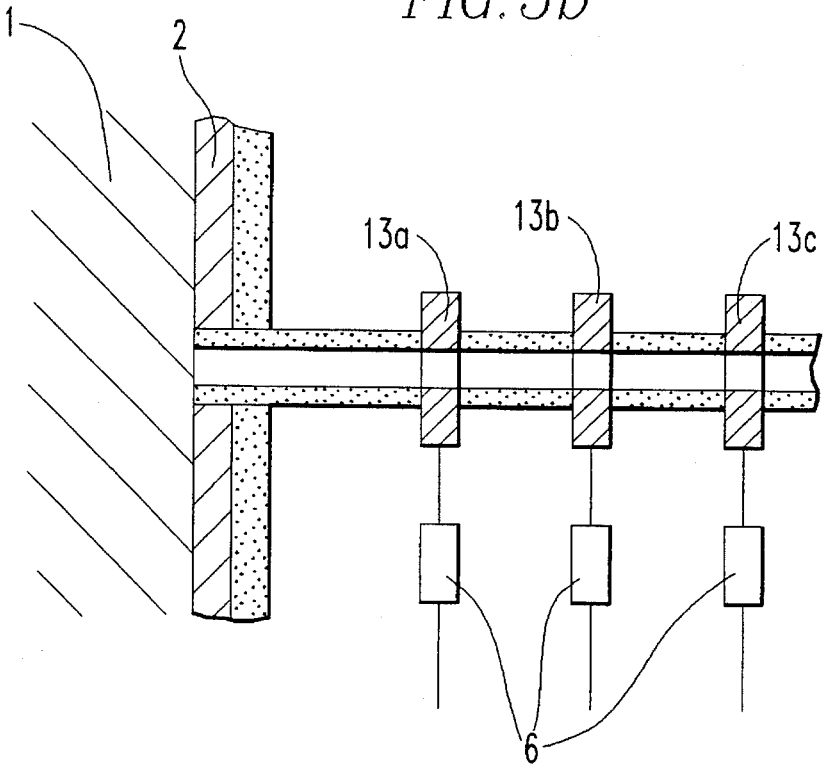
FIG. 3*b* shows potential control by means of auxiliary electrodes arranged between the end electrodes.

For the acceleration of ions the potential of the reservoir 1 is at anode potential. Because of the shielding effect of the electrons and the small movability of the ions the density of the plasma in the reservoir 1 at the entrance to the dielectric tube 5 needs to be high. For an effective withdrawal of the ions out of the plasma into the dielectric tube 5, the acceleration section (up to the first auxiliary electrode 13*a*, see FIG. 3*b*) needs to be short and, because of the Child-Langmuir law, the potential must be selected to be high. The auxiliary electrode then begins to carry current. The ohmic or inductive resistors 6 via which the auxiliary electrodes 13*a*, 13*b*, 13*c* and the cathode are interconnected permits the first auxiliary electrode 13*a* to drift down to anode potential. Then a subsequent second auxiliary electrode 13*b* takes over the build-up of an electric field and then also this electrode is deactivated by a current load, a subsequent electrode 13*c* takes over, etc. (see FIG. 3*b*). In order to keep the operating cross-sections for the recharging with ions log, the residual pressure must be as low as possible. In an examplary embodiment it was at about 0.1 Pa.

This way of accelerating ions has two advantages: Firstly, the auxiliary electrodes 13 operate like a linear accelerator; secondly, the ion beam leaves the dielectric tube 5 in good parallelism.

The canal discharge is first of all a simple and cost efficient source for high-current oriented electron and ion beams by which process energy can be deposited in static or differentially pumped gases, gas mixtures and mixtures of gas and aerosoles. For example, by differential pumping in the dielectric tube 5, a gas target can be created in which the electron beam is slowed down in the gas while generating deceleration and characteristic radiation. Aerosoles of unknown composition can be continuously conducted through the dielectric tube wherein they are totally ionized by the electron beam and can be identified on the basis of their characteristic radiation.

By means of the particle beams, material can be irradiated, removed and worked (see FIG. 2). The removal process in the case of electrons is ablation; in the case of ions, it is atomization including hot processes.

The sputtered, ablated and atomized materials 33 mainly move away from the target 14 in a direction normal to the target 14 and consist, about in the order of the power density of the particle beam, of ions, atoms, molecules, clusters and aerosoles of any size which are partly still excited and carry excess charges.

The target material which has been sputtered, ablated and vaporized by the particle beam can be utilized for the manufacture of layers of substrates by the Tayloring process (each atomic layer is different), as atomic mixture (between otherwise incompatible materials) and as compound material on high-strength fibers or similar.

Layers of substrates can also be manufactured with atomic material which is released from a gaseous chemical compound by exposure to the particle and/or electromagnetic radiation.

The high-current electron/ion beams from the canal discharge form a particle source of high definition and high current flow and, after passing a differentially pumped passage, can be introduced into intermediate and high energy accelerators.

The plasma formed upon impingement of the particle beams onto a target is a powerful pulsed source of electromagnetic radiation (light, UV, VUV, soft X-ray radiation).

Figure 7:
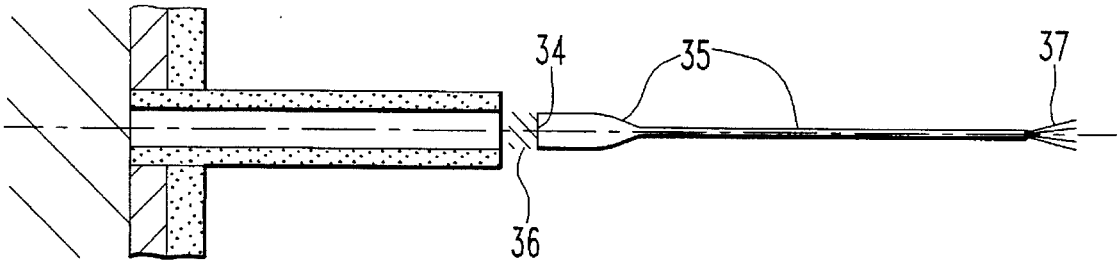
FIG. 7 shows a pulsed light source.

A very intense pulsed light source 37 is obtained by bombarding the front face 34 of a light conductor 35 with the particle beam (see FIG. 7). Hereby, a very hot plasma 36 is generated from the light conductor material providing for light radiation which, because of its spectral composition and high density at the point of generation, is coupled into the light conductor with high efficiency.

Concurrently with the generation of the electron beam, a plasma is formed in the dielectric tube and microwaves are generated by the interaction of the electron beam with the plasma which pass through the dielectric tube and exit therefrom in an unattenuated and undisturbed condition.

At the cathodic entrance of the dielectric tube a zone of very hot plasma is formed. If the canal discharge is used as a process preceding a subsequent z-pinch, this area can be magnetically compressed over an extended period and can be heated by ohmic procedures. In this manner, it is possible to maintain the plasma for more than a microsecond at a temperature of Te=200 eV with a primary energy of only 15 joules. By predetermined contamination with atoms of higher atomic number a simple plasma source of light, UV, VUV and soft X-ray radiation up to an energy of 2 keV becomes available. Because of the low linear density of the plasma formed from the residual gas, the line widening of the radiation is also very small. The efficiency of the emitted radiation of between 10 eV and 2 keV is about 10%, that of the radiation between 700 eV and 2 keV is less than one part per mille (1/1000).

The electron beam of the canal discharge is characterized by a high current in the lower kA-range with a comparably low acceleration voltage (5–10 kV) and is suitable for the generation of pulsed soft heterochromatic radiation upon impingement of the well-focussed electron beam onto a target. With this heterochromatic radiation, biological structures in the micrometer range can be depicted by shadow formation.

Since, at the canal accelerator 11, voltage differences of up to 100 kV can be maintained, the canal discharge is suitable for use as an uninhibiting and switchable switch for high voltages. For lower voltages the canal discharge may also be used as an impulse generator with repetition frequencies up to 100 kHz.

What is claimed is:

1. A particle accelerator for accelerating electrically charged particles, comprising: a pulsed plasma reservoir of high particle density, a dielectric tubular chamber having an inner diameter d and extending from said reservoir, at least two electrodes disposed around said tubular chamber in spaced relationship from one another, one electrode being arranged along on inside wall of said reservoir, means for evacuating said dielectric tubular chamber to maintain only a residual gas charge with a sufficiently low pressure p such that the product of the gas pressure p and the inner diameter d of the dielectric tube (pxd) is low enough to avoid parasitic discharges in said residual gas charge, means for applying a voltage to said electrodes for drawing said charged particles from said reservoir into said dielectric tubular chamber and for accelerating them therein so as to form a charged particle beam in said dielectric tubular chamber by which the residual gas charge in said dielectric tubular chamber is ionized along the inside wall thereof and polarized providing for wall repulsive and axis attractive forces capable of electrostatically focusing said charged particle beam exiting said dielectric tubular chamber.

2. A particle accelerator according to claim 1, wherein said dielectric tubular chamber has a minimum length of three times its inner diameter.

3. A particle accelerator according to claim 1, wherein, for maintaining the axial electrical insulation during contamination, said dielectric tubular chamber between said two electrodes is formed by a system of dielectric tube segments arranged in coaxial alignment and interconnected by dielectric bodies with coaxially aligned internal passages having inner radial slots by which the flow of inner surface currents between said tube segments is prevented.

4. A particle accelerator according to claim 3, wherein said slots of the dielectric bodies include further a recess such that a subsequent rear space following the recess is protected from contamination and surface conductivity.

5. A particle accelerator according to claim 1, wherein near the end of said dielectric tubular chamber toward the other electrode, a gas supply with a gas supply hose is provided through which gas can be supplied so as to flow toward said reservoir and toward a receiver, in which the other electrode is disposed.

6. A particle accelerator according to claim 5, wherein a dielectric tube is disposed in said gas supply hose between said tubular chamber and a gas source, and, for preventing a parasitic gas discharge to the gas source, the dielectric tube has an inner diameter of at most ½ the diameter of said dielectric tubular chamber and opposite end faces provided with two electrodes of which one electrode which is closer to said gas source is grounded and the other is free-floating.

7. A particle accelerator according to claim 1, wherein said reservoir comprises a pulsed high density plasma.

8. A particle accelerator according to claim 1, wherein said reservoir is maintained at an electrically high potential, and a dielectric tube which has about the same inner diameter and the same length as said dielectric tubular chamber is connected at one end to said reservoir and at the other end to a trigger charge source for conducting a trigger charge flow of low energy to the reservoir through said dielectric tube.

9. A particle accelerator according to claim 8, wherein said dielectric tube, through which the trigger charge flow of low energy is supplied to the reservoir, is grounded at its other end by way of a resistor such that side discharges to the trigger source cannot cause any damage.

10. A particle accelerator according to claim 1, wherein means are provided for applying locally limited magnetic fields to the particle beam in said dielectric tubular chamber at predetermined locations to achieve a predetermined deflection of the beam.

11. A particle accelerator according to claim 1, wherein the flow density of the particle beam exiting from said dielectric tubular chamber is controlled by varying the cross-section of said dielectric tubular chamber.

12. A particle accelerator according to claim 11, wherein a ring shaped auxiliary electrode is disposed in a dielectric wall of said tubular chamber.

* * * * *